US005657918A

United States Patent [19]

Shimomura et al.

[11] Patent Number: 5,657,918

[45] Date of Patent: Aug. 19, 1997

[54] ELECTRIC STAPLER

[75] Inventors: Shigehiko Shimomura, Moriyama; Shigehiko Fujita, Hirakata; Yuji Wada, Katano; Kenji Yamamura, Neyagawa, all of Japan

[73] Assignee: Matsushita Electric Industrial Co., Ltd., Kadoma, Japan

[21] Appl. No.: 426,719

[22] Filed: Apr. 21, 1995

[30] Foreign Application Priority Data

Apr. 21, 1994 [JP] Japan ..... 6-083090

[51] Int. Cl.[6] ..... B27F 7/36

[52] U.S. Cl. ..... 227/7; 227/131

[58] Field of Search ..... 227/131, 7, 110, 227/120

[56] References Cited

U.S. PATENT DOCUMENTS

| | | | |
|---|---|---|---|
| 2,403,947 | 7/1946 | Oussani | 227/131 |
| 3,282,489 | 11/1966 | March | 227/131 |
| 4,491,260 | 1/1985 | Jimena | 227/131 |
| 4,720,033 | 1/1988 | Olesen | 227/131 |
| 4,726,505 | 2/1988 | Okazaki | 227/132 |
| 5,330,086 | 7/1994 | Shimomura et al. | 227/7 |
| 5,427,296 | 6/1995 | Chen | 227/131 |

*Primary Examiner*—Rinaldi I. Rada
*Assistant Examiner*—Boyer Ashley
*Attorney, Agent, or Firm*—Ratner & Prestia

[57] ABSTRACT

An electric stapler is automatically adjustable with regard to the stapling position and the stapling operation. The electric stapler consists of a switch lever limiting and detecting the insertion of papers to be stapled, a switch lever adjuster for adjusting the position of the switch lever, and an AC-DC converter mounted on a base for the stapler.

1 Claim, 3 Drawing Sheets

ELECTRIC STAPLER

FIELD OF THE INVENTION

The present invention relates to an electric stapler using a motor to drive a staple into sheets of paper to be stapled.

BACKGROUND OF THE INVENTION

In a conventional electric stapler, a direct current (DC) motor is driven using alternating current (AC) which is converted into DC by means of an AC adaptor or a complicated electronic circuit. However, with the electric stapler of this construction, the stapler can not be constructed in a compact form, and has to be made of a large number of components packed into a large volume.

When using these staplers, in order to change the stapling position on the papers to be stapled, a horizontal L-shaped sliding metal positioning fitting must be shifted in order to adjust the stapling position, and after this, the motor is operated by pressing the motor switch button and the staple is driven into the papers.

The horizontal L-shaped metal fitting, however, has to be moved into a proper position which requires a troublesome positioning operation to achieve. Also, since insertion of sheets of paper to be stapled and the stapler operation are conducted independently, stapling operations are further complicated.

SUMMARY OF THE INVENTION

The present invention solves the above problems, with an electric stapler of compact construction by which the adjustment of the stapling position and operation of the stapler can be substantially simplified.

An electric stapler having a compact construction is provided in which the adjustment of staple position and performance of a stapling operation are substantially simplified. The electric stapler is provided with a paper holder to press down the area surrounding the point at which the staple is struck and a switch lever which, upon detecting insertion of a predetermined number of papers to be bound, actuates an electric motor. A switch lever position adjuster is also provided such that the position of the staple on the papers to be bound can be adjusted. An AC-DC converter is also mounted on the base of the stapler so that a compact packaging volume is achieved.

The electric stapler of the present invention can be made into a compact form with an adjustable staple position in the papers to be bound. Additionally, the switch lever which only actuates the motor upon detecting a predetermined number of papers to be bound facilitates the operations of inserting and stapling the papers.

The electric stapler of the present invention is constructed on a base comprising a stapler casing, on which are mounted an AC-DC converter, an electric motor, a circuit to control the operation of the electric motor, a series of gears driven by the electric motor, and a driving gear driven by the series of gears. A boss is provided on a side face of the driving gear, with a rod having a slide slot being provided in which said boss is engaged. A hammer coupled with the rod is driven by the electric motor and strikes a staple into papers to be stapled while a paper press presses and holds the papers while the staple is struck into the papers. A switch-lever which limits the number of papers to be inserted, turns on the electric motor upon detecting the insertion of the papers. A switch lever position adjuster is also provided which adjusts the position of the switch lever so that the position of the staple on the papers to be stapled can be adjusted.

As a result, because the converter for converting AC power into DC power is mounted on the base of the casing, the electric stapler can be made into a compact form. Also, because the switch-lever position adjuster is adjustable together with the switch lever, the position of staple struck into the papers can be adjusted very easily.

Moreover, since the motor striking the staple into the papers can be turned ON automatically only when the insertion of the paper to be stapled into the stapler is detected, and the setting of papers into the stapler and the striking of the staple upon detecting the insertion of papers can be made simultaneously, the operations of the stapler are substantially simplified.

DETAILED DESCRIPTION OF THE INVENTION

Figure 1:
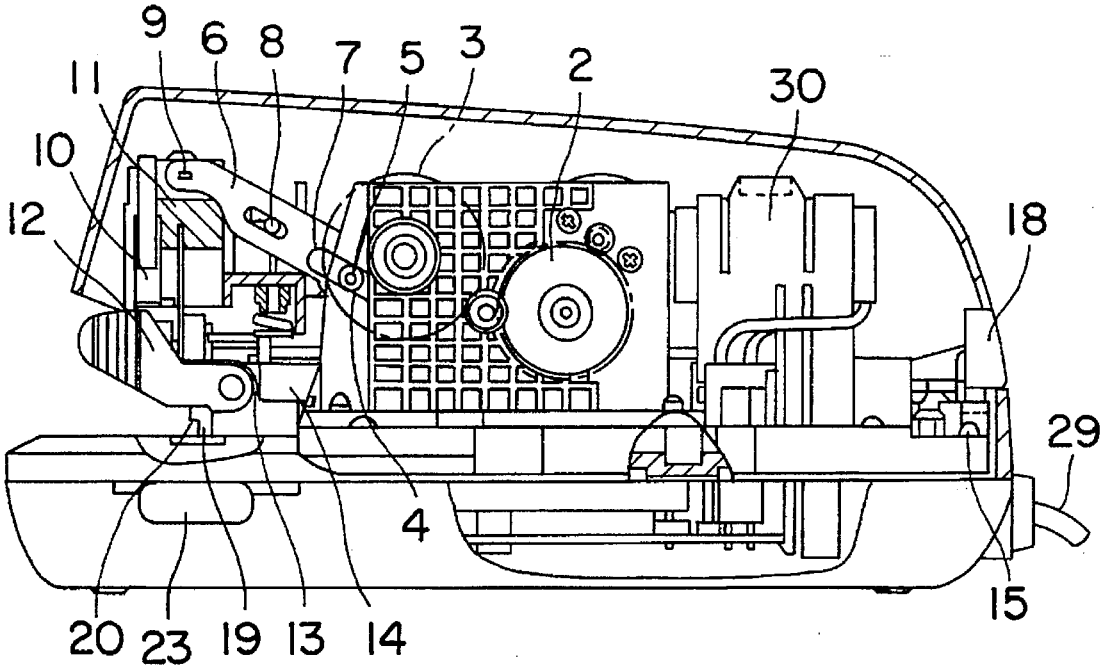
FIG. 1 is a sectional view of an electric stapler according to an exemplary embodiment of the present invention.
Figure 2:
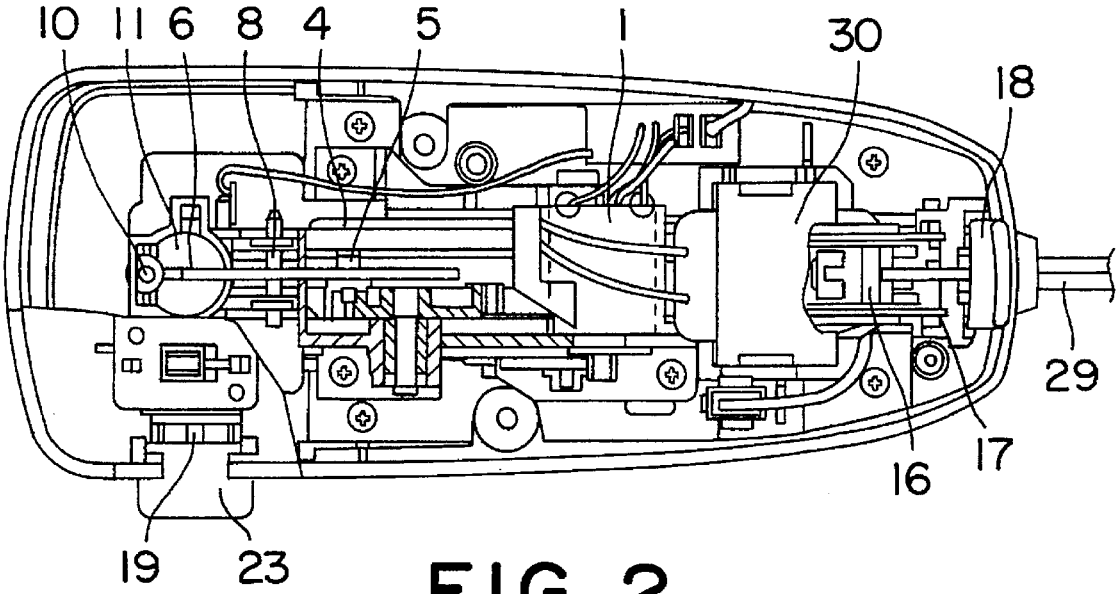
FIG. 2 is a top view of an electric stapler according to an exemplary embodiment of the present invention with the cover removed.

An example of an electric stapler according to the present invention is explained below with reference to the drawings.

FIGS. 1, 2, 5A and 5B show an example of an electric stapler according to the present invention. The driving torque of an electric motor 1 is transmitted via a train of serially engaged gears 2, to a driving gear 3 disposed at the last stage of the serially engaged gears. A boss 4 (FIG. 2) is disposed on the side of driving gear 3. A roller 5 is disposed on the boss 4 and is engaged with slot 7 of rod 6. A hammer 11 is attached to the end of rod 6 and moves reciprocally upward and downward upon rotation of the motor 1. This is achieved by fulcrum 8 which delivers the rotational movement produced by driving gear 3 to the other end of rod 6 such that when shaft 9 disposed on the other end of rod 6 is pushed down, hammer 11 and paper press 12 are lowered.

Staples are housed in staple case 13 which is held by staple case outer frame 14. Axis 15 of outerframe 14 of staple case 13 allows the up and down movements of staple case 13 and the staple case outerframe 14 when a staple is struck into a stack of papers.

A holding pin 16 applies a striking force on staple case 13 which is held in place by spring 17, by which staples can be inserted or removed from staple case 13. A push button 18 changes the position of holding pin 16 when it is pushed, and by this, staple case 13 is moved forward by means of spring 17.

An inverted generally L-shaped switch lever 19 having a bent portion 20 protruding toward the direction from which a stack of papers is inserted is provided. This prevents the over insertion of papers and, thus the position of the staple can be determined exactly.

Figure 3:
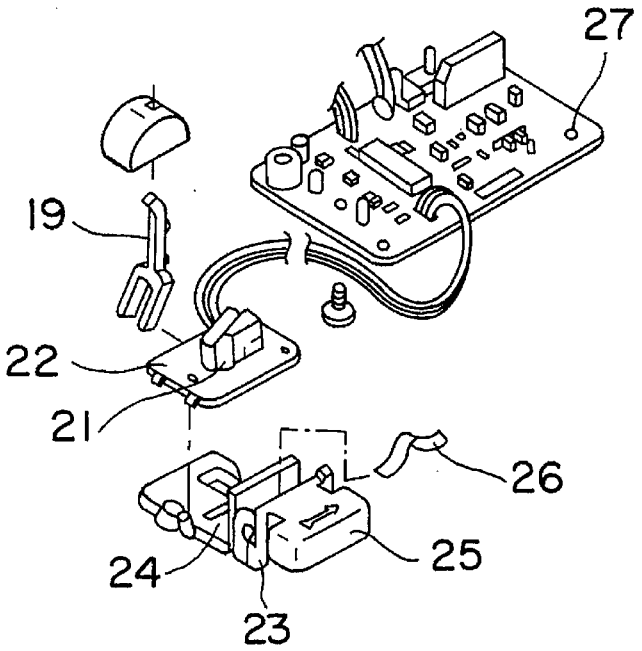
FIG. 3 is an isometric exploded view of a switch lever block assembly incorporated in the present invention.

FIG. 3 shows an exploded view of a switch lever block assembly disposed on switch mounting plate 22 together with micro-switch 21. A position adjuster 23 adjusts the position of switch lever 19, and is provided with switch holder 24 and knob 25. Switch holder 24 is further provided with switch holding plate 22 and a generally W-shaped leaf spring 26. When switch lever 19 is pressed inwardly by the papers to be stapled, micro-switch 21 is turned ON and the degree of insertion or the stapling position of papers is determined.

Figure 4:
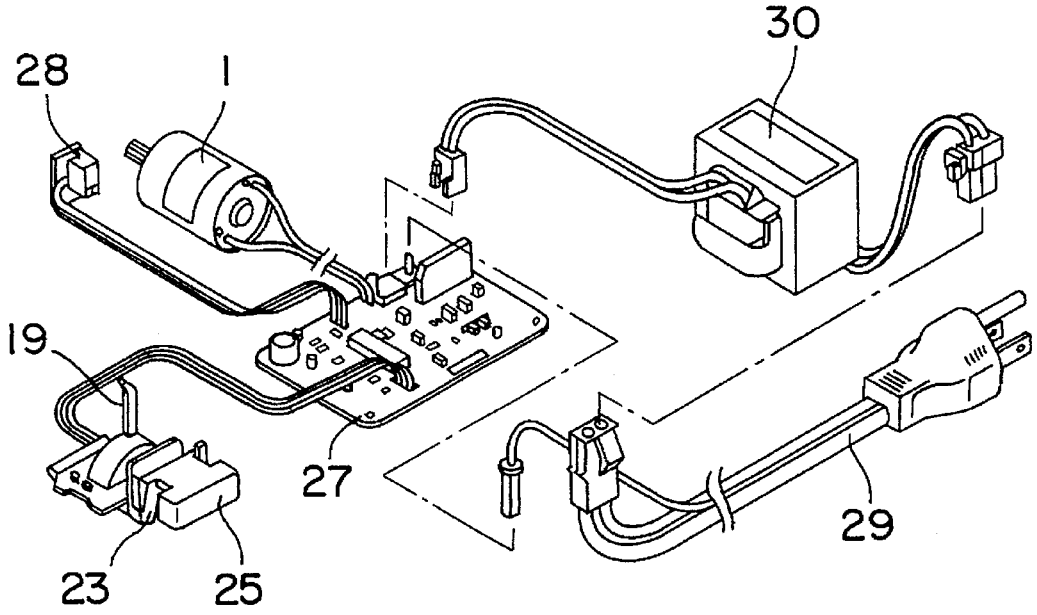
FIG. 4 is an isometric exploded view of the switch lever block assembly shown in FIG. 3 connected to a power supply transformer.
Figure 5A:
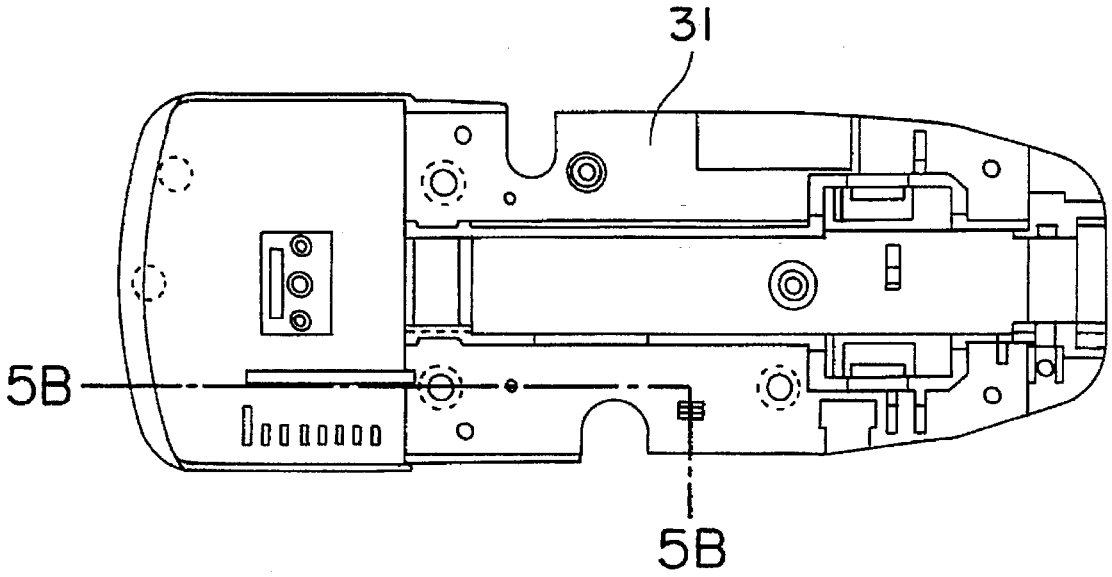
FIG. 5A is a top view of a stapler base of an electric stapler of the present invention.
Figure 5B:
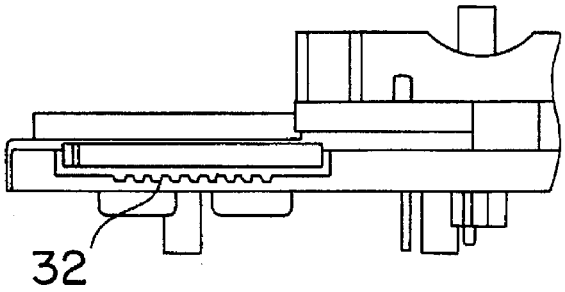
FIG. 5B is a side view taken along line 5B—5B in FIG. 5A showing the base upon which the switch lever block assembly is mounted.

Furthermore, switch lever 19 is engaged with electronic component mounting plate 27, motor 1, and micro-switch 28 for stopping the rotation of motor 1. AC power line 29, and AC-DC converter 30 are mounted on electronic component mounting plate 27 as shown in FIG. 4. The position of switch lever 19 is adjustable stepwise in a forward or backward direction by engaging a row of plural indentations 32 provided on base 31 as shown in FIGS. 5(A) and 5(B).

The operations of these components are now explained below. When a stack of the papers to be stapled is inserted in the stapler, switch lever 19 is moved causing rotation of motor 1. Rotation of motor 1 causes rod 6 to rotate by boss 4 engaging driving gear 3 which is disposed at the last stage of gear train 2 driven by motor 1.

Push rod 10 is pushed around fulcrum 8 by shaft 9 provided at the other end of rod 6. Paper press 12 is lowered to press the papers inserted in the stapler and the staple housed in outer staple case 14 and staple case 13 is struck downward so that the legs of staple passed through the inserted paper and are bent at the staple bending part.

After the stapling operation, driving gear 3 is further rotated to push the end of shaft 9 opposite to hammer 11, and by this, hammer 1t and push-rod 10 are pushed upward to the top dead point. Staple case 13 and paper press 12 are reset to the original positions by means of spring 17 while the rotation of motor 1 is stopped by means of micro-switch 28 as soon as paper press 12 and hammer 11 are raised to the original positions, and the stapler operation can be reset to the original condition by removing the stapled papers.

For adjusting the stapling position on the papers, knob 2S of switch position adjuster 23 is moved in either a forward or backward direction, and by this. W-shaped leaf spring 26 of switch position adjuster 23 is moved within a row of plural indentations 32 provided on base 31 as shown in FIGS. 5(A) and 5(B). By this, the position of switch lever 19 is adjustable stepwise in a forward or backward direction by means of click stops. Thus, the staple can be struck into any position apart from the edge of the papers to be stapled by adjusting the distance between the hammer 11 and the switch lever 19.

What is claimed:

1. An electric stapler comprising:

a casing having a base on which an AC-DC converter, an electric motor, a circuit for controlling the operation of said electric motor, a series of gears driven by said electric motor, and a driving gear driven by said gears, are mounted, a boss provided on a side face of said driving gear, a rod provided with a slide slot in which said boss is engaged, a hammer coupled with said rod driven by said electric motor for striking a staple into papers to be stapled, a paper press for pressing said papers while said staple is struck into said papers, a switch lever for limiting the number of said papers to be stapled and for turning said electric motor ON upon detecting the insertion of said papers, and a switch lever position adjuster for adjusting said switch lever so that the position of said staple on said papers can be changed, wherein said switch lever position adjuster comprises a knob, a micro-switch, and a switch holder provided with a W-shaped leaf spring, and said switch level position adjusted is mounted to the base, the base provided with serially disposed indentations fitted to protruded parts of said leaf spring so that the position of said switch lever is adjustable by adjusting said knob.

* * * * *